United States Patent [19]

Cordea et al.

[11] Patent Number: 4,502,886

[45] Date of Patent: Mar. 5, 1985

[54] AUSTENITIC STAINLESS STEEL AND DRILL COLLAR

[75] Inventors: James N. Cordea, Monroe; Joseph C. Jasper, Middletown, both of Ohio; Harshad V. Sheth, Rancho Palos Verdes, Calif.

[73] Assignee: Armco Inc., Middletown, Ohio

[21] Appl. No.: 455,990

[22] Filed: Jan. 6, 1983

[51] Int. Cl.[3] ..... C22C 38/58

[52] U.S. Cl. ..... 75/125; 75/128 A; 75/128 N; 148/38; 148/12 E; 148/12 B

[58] Field of Search ..... 75/125, 128 A, 128 N; 148/38, 12 E, 12 B, 37

[56] References Cited

U.S. PATENT DOCUMENTS

| | | | |
|---|---|---|---|
| 3,082,083 | 3/1963 | Levy et al. | 75/128 A |
| 3,112,195 | 11/1963 | Souresny | 148/38 |
| 3,756,807 | 9/1973 | Hoshino et al. | 75/128 A |
| 3,940,266 | 2/1976 | Goller et al. | 75/128 A |
| 4,386,957 | 6/1983 | Farmer et al. | 75/128 A |

FOREIGN PATENT DOCUMENTS

| | | | |
|---|---|---|---|
| 53-106620 | 9/1978 | Japan | 148/38 |

*Primary Examiner*—L. Dewayne Rutledge
*Assistant Examiner*—Debbie Yee
*Attorney, Agent, or Firm*—Frost & Jacobs

[57] ABSTRACT

A non-magnetic austenitic stainless steel, and a drill collar fabricated therefrom solely by hot forging, the steel having a 0.2% yield strength of at least 85 ksi in the hot worked condition, high stress corrosion cracking resistance, good ductility, and low magnetic permeability even if cold worked, and consisting essentially of, in weight percent, from 0.12% to 0.20% carbon, 11% to 14% manganese, about 16% to about 19% chromium, 1.5% to 2.7% nickel, 0.30% to 0.45% nitrogen, 0.5% to 1.0% copper, about 0.75% maximum molybdenum, about 0.80% maximum silicon, about 0.04% maximum phosphorus, about 0.025% maximum sulfur, and balance essentially iron, with the carbon:nitrogen ratio not greater than 0.6:1.

23 Claims, 1 Drawing Figure

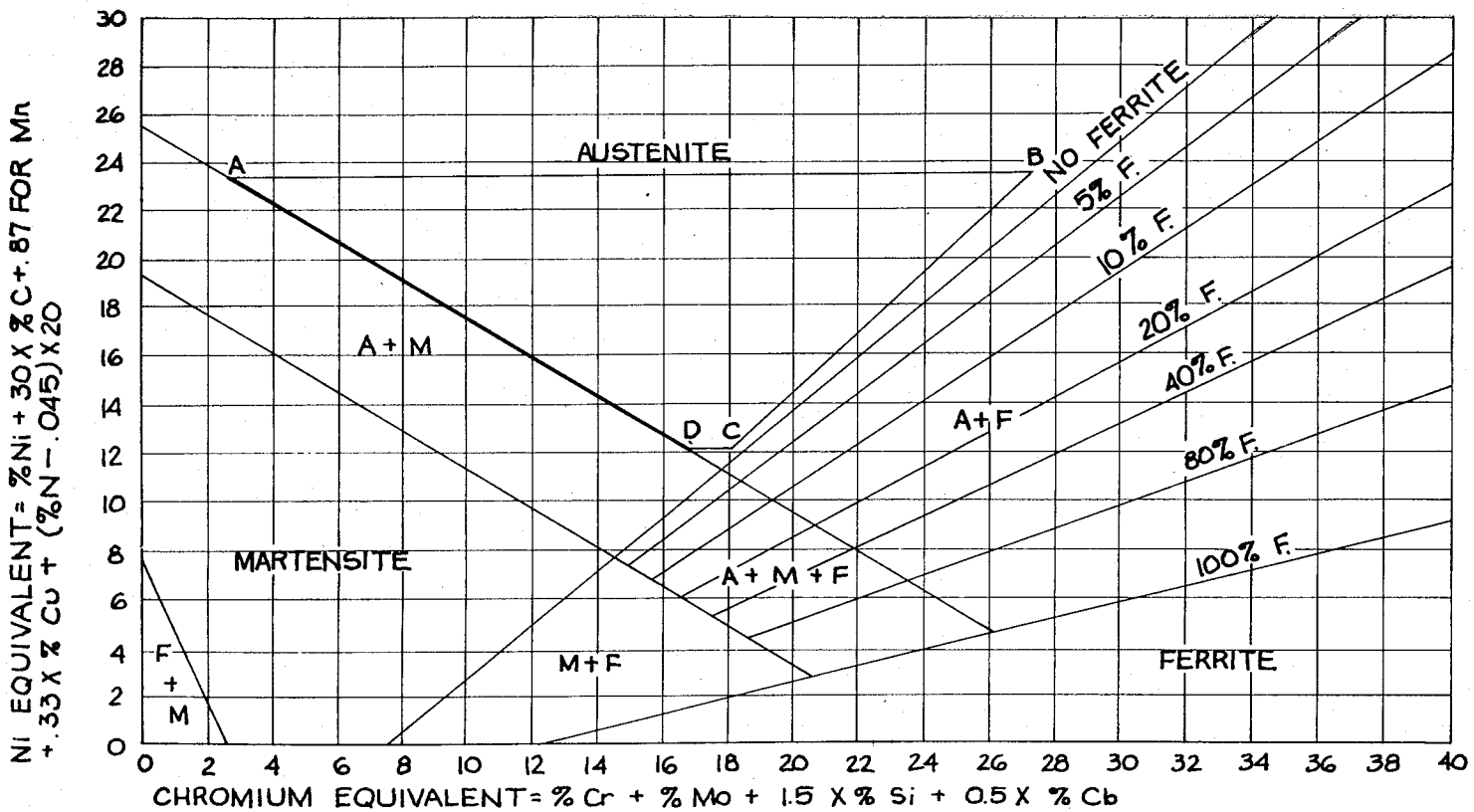
AUSTENITE
A
A+M
D
C
A+F
A+M+F
M+F
MARTENSITE
F + M
B
NO FERRITE
5% F.
10% F.
20% F.
40% F.
80% F.
100% F.
FERRITE
CHROMIUM EQUIVALENT = % Cr + % Mo + 1.5 X % Si + 0.5 X % Cb
Ni EQUIVALENT = %Ni + 30 X %C + .87 FOR Mn + .33 X % Cu + (%N − .045) X 20

AUSTENITIC STAINLESS STEEL AND DRILL COLLAR

BACKGROUND OF THE INVENTION

This invention relates to an austenitic stainless steel which is substantially fully non-magnetic in the hot worked and forged condition, to oil well drill collars fabricated therefrom and to a method of making drill collars which have high strength and improved resistance against stress corrosion cracking.

Drill collars are used in oil well drilling in order to provide the proper loads on the drill bit. In directional drilling it is necessary to provide electronic measuring and guidance instruments in the drill stem. Non-magnetic drill collars are therefore necessary in order to ensure proper functioning of the electronic instruments. Due to the greater drilling depths presently being explored, higher temperatures are encountered together with chloride and sulfide containing liquids. Such conditions exacerbate stress corrosion cracking problems in austenitic steels.

The non-magnetic steel of the present invention exhibits a surprising increase in strength in the hot worked condition and improvement in stress corrosion cracking resistance in comparison to a conventional prior art steel widely used for fabrication of drill collars. Moreover, the steel of the invention can be fabricated into drill collars without the "warm working" treatment required for the conventional steel, and without cold working.

U.S. Pat. No. 3,082,083, to Levy and Goller, discloses a prior art steel which has been widely used in the fabrication of drill collars and describes the forging and warm working treatments to which the steel is subjected, viz., rough forging at 1800°-2100° F. (982°-1149° C.), reheating and further forging at 1300°-1500° F. (704°-815° C.) with a reduction of about 20%. When forged at 1800°-2100° F. the yield strength is about 60 ksi. Reheating and warm working increases the yield strength to about 100 ksi. Cold working the steel of this patent raises the yield strength to above 100 ksi. The steel of this patent consists essentially of 0.10% to 0.25% carbon, 7% to 14% manganese, 12% to 18% chromium, greater than 5% to 15% nickel, 0.15% to 0.5% nitrogen, and balance essentially iron. In the cold or warm worked condition the magnetic permeability is alleged to be not greater than 1.007.

U.S. Pat. No. 3,940,266 and a division thereof, U.S. Pat. No. 3,989,474, to Goller and Espy, disclose an austenitic stainless steel combining good stress corrosion cracking resistance and cryogenic toughness, consisting essentially of 0.06% to 0.12% carbon, 11% to 14% manganese, 15.5% to 20% chromium, 1.1% to 2.5% nickel, 0.20% to 0.38% nitrogen, 0.5% maximum copper, 0.5% maximum molybdenum, and balance essentially iron. Another embodiment contains 0.01% to 0.06% carbon and 2.5% to 3.75% nickel, with the ranges of all other elements remaining the same.

An austenitic steel sold by Armco Inc. under the trademark "Aquamet 18" for boat shafts, contains 0.15% maximum carbon, 11.0% to 14.0% manganese, 16.5% to 19.0% chromium, 0.5% to 2.50% nickel, 0.20% to 0.45% nitrogen, and balance essentially iron.

U.S. Pat. No. 3,112,195 discloses an austenitic steel alleged to be suitable, in the cold worked condition, for drill stems (collars) in oil well drilling. In broad ranges the steel of this patent contains up to 0.35% carbon, 12% to 25% manganese, 10% to 20% chromium, up to 5% nickel, 0.05% to 0.50% nitrogen, up to 1% molybdenum, and balance essentially iron. Optional alloying additions include tungsten, titanium, columbium (and/or tantalum), boron, vanadium, copper and cobalt, in a total amount not exceeding 10%.

U.S. Pat. No. 3,904,401, to Mertz et al, discloses an austenitic steel consisting essentially of 0.25% maximum carbon, 15% to 20% manganese, 16% to 22% chromium, 3% maximum nickel, 0.2% to 0.8% nitrogen, 0.5% to 3% molybdenum, 0.5% to 2% copper, 0.5% maximum sulfur, and balance essentially iron.

Despite the availability of the alloys disclosed in the above-mentioned patents, and other alloys such as K-Monel (containing at least 63% nickel and at least 25% copper), nominal 18% chromium-8% nickel steels and 15% chromium-5% nickel steels, for fabrication into oil well drill collars, there is still a need for an alloy which combines high stress corrosion cracking resistance, low alloy cost, and high strength in the hot worked condition and low magnetic permeability. Thus, the steel of U.S. Pat. No. 3,082,083 is deficient in stress corrosion cracking resistance and requires warm working to achieve the desired strength levels. The steels of U.S. Pat. Nos. 3,112,195; 3,940,266 and 3,989,474 require cold working to achieve the desired strength levels. Alloys such as K-Monel and 18-8 and 15-5 stainless steels are prohibitive in cost because of the high nickel contents thereof.

It has now been discovered, in accordance with the present invention, that observance of critically narrow percentage ranges of the essential elements carbon, manganese, chromium, nickel, nitrogen and copper, and critical proportioning therebetween, particularly carbon and nitrogen, result in a non-magnetic, substantially fully austenitic stainless steel which exhibits improved stress corrosion cracking resistance, adequate toughness, good ductility, and a high yield strength in the hot worked condition which makes it unnecessary to resort to the prior art warm working practice of U.S. Pat. No. 3,082,083 and the cold working described in U.S. Pat. No. 3,112,195. When fabricated into drill collars by forging and hot working, the magnetic permeability of the steel of the invention does not exceed 1.004 even if cold worked.

The present invention thus provides an austenitic stainless steel having a 0.2% yield strength of at least 85 ksi, a stress corrosion resistance of greater than 1,000 hours under stress of 25 ksi in boiling 42% magnesium chloride solution, and a reduction of area of at least about 50% in the hot worked condition, and a magnetic permeability not greater than 1.004 at 500 oersteds in the cold worked condition, said steel consisting essentially of, in weight percent, from 0.12% to about 0.20% carbon, 11% to about 14% manganese, about 0.80% maximum silicon, about 0.04% maximum phosphorus, about 0.025% maximum sulfur, about 16% to about 19% chromium, about 1.5% to 2.7% nickel, 0.30% to 0.45% nitrogen, 0.5% to about 1.0% copper, about 0.75% maximum molybdenum, and balance essentially iron, with the carbon:nitrogen ratio being not greater than about 0.6:1.

The term "balance essentially iron" is intended to include iron with minor amounts of unavoidable impurities which do not adversely affect the properties of the steel.

The invention further provides a non-magnetic oil well drill collar produced by hot forging having a 0.2% yield strength greater than 85 ksi at the longitudinal outside diameter position, a stress corrosion cracking resistance of greater than 1000 hours under stress of 75 ksi in boiling 5% NaCl+0.5% acetic acid solution, and a magnetic permeability not greater than 1.004 at 500 oersteds, said collar being hot forged from an austenitic stainless steel consisting essentially of, in weight percent, from 0.12% to about 0.20 carbon, 11% to about 14% manganese, about 0.80% maximum silicon, about 0.04% maximum phosphorus, about 0.025% maximum sulfur, about 6% to about 19% chromium, about 1.5% to 2.7% nickel, 0.30% to 0.45% nitrogen, 0.5% to about 1.0% copper, about 0.75% maximum molybdenum, and balance essentially iron, with the carbon:nitrogen ratio being not greater than about 0.6:1.

In accordance with the invention, a method of fabricating a non-magnetic oil well drill collar, having a 0.2% yield strength greater than 85 ksi at the longitudinal outside diameter position, a stress corrosion cracking resistance of greater than 1000 hours under stress of 75 ksi in boiling 5% NaCl+0.5% acetic acid solution, and a magnetic permeability not greater than 1.004 at 500 oersteds, comprises the steps of providing a steel billet consisting essentially of, in weight percent, from 0.12% to about 0.20% carbon, 11% to about 14% manganese, about 0.80% maximum silicon, about 0.04% maximum phosphorus, about 0.025% maximum sulfur, about 16% to about 19% chromium, about 1.5% to 2.7% nickel, 0.30% to 0.45% nitrogen, 0.5% to about 1.0% copper, about 0.75% maximum molybdenum, and balance essentially iron, with the carbon:nitrogen ratio being not greater than about 0.6:1, heating said billet within the range of about 982° to about 1149° C. (1800° to 2100° F.), and hot forging the billet to final diameter without intermediate reheating at a finishing temperature of at least about 677° C.

BRIEF DESCRIPTION OF THE DRAWING

The drawing is a modified Schaeffler phase diagram illustrating the nickel equivalent and chromium equivalent ranges of the steel of the invention.

DETAILED DESCRIPTION

Drill collars in accordance with the invention may range up to 11 inches in outside diameter. As explained in the above-mentioned U.S. Pat. No. 3,082,083 the drill collars may range in length from about 14 to 32 feet and may weigh from about 800 lbs to about 3400 lbs.

As indicated above ingots or billets are hot reduced by forging to the desired final outside diameter after being heated to a temperature of about 980° to about 1150° C. Warm working for final reduction is not practiced with the steel of the present invention, and in addition to decreasing processing costs elimination of warm working has been found to result in lower residual stresses in the drill collars and a relatively fine grain size, e.g. on the order of ASTM 5-6 with some larger grains at the surface. Optionally the larger diameter drill collars may be quenched after hot working in order to ensure that carbon is not drawn out of solution by sensitization which could occur during slow cooling of relatively massive work pieces.

The forged work pieces are then trepanned to form a central bore of desired diameter. No heat treatment is needed after trepanning.

The preferred composition of the steel of the present invention consists essentially of, in weight percent, from 0.12% to 0.18% carbon, 11% to about 13% manganese, about 0.5% maximum silicon, about 0.03% maximum phosphorus, about 0.02% maximum sulfur, about 17% to about 18.5% chromium, about 1.8% to 2.5% nickel, 0.30% to about 0.39% nitrogen, 0.5% to about 0.9% copper, about 0.5% maximum molybdenum, and balance essentially iron.

Referring to the drawing, a proportioning of the elements is preferably observed which will result in a nickel equivalent and chromium equivalent falling within the area ABCD.

The nickel equivalent is calculated as follows:

Ni equivalent=% Ni+30×% C+0.87 for Mn+0.33×% Cu+20(% N-0.045)

The chromium equivalent is calculated as follows:

Cr equivalent=% Cr+% Mo+1.5×% Si 0.5×% Cb

It is apparent that the balancing among the essential elements of the present steel is such as to fall wholly within the austenite region of the modified Schaeffler diagram of the drawing. In the preferred composition no ferrite and no martensite are present in the steel under any conditions of fabrication or use.

Carbon is essential for its function as a strong austenite former and for its contribution to strength. For these purposes at least 0.12% carbon is required. However, a maximum of about 0.20% should be observed in order to ensure good stress corrosion cracking resistance. Preferably carbon ranges between about 0.12% and 0.18%.

Manganese is essential primarily for its austenite stabilizing function and also as a weak austenite former. In addition, manganese helps to hold nitrogen in solution, and a minimum of 11% is necessary for this purpose. More than 14% would tend to affect the mechanical properties adversely and with copper present excessive manganese may result in hot shortness. Preferably manganese ranges between about 11% and 13.0%.

Chromium is essential in order to confer corrosion resistance. For this purpose a minimum of about 16% is needed, but a maximum of about 19% must be observed in order to ensure a fully austenitic microstructure under all conditions. Preferably chromium ranges between about 17.0% and about 18.5%.

Nickel is essential as an austenite former and to confer toughness. A minimum of 1.5% nickel is necessary for this purpose, but a maximum of 2.7% should be observed in order to ensure good stress corrosion cracking resistance and to minimize cost. Preferably nickel ranges between 1.8% and 2.5%, and optimum toughness is obtained within the range of about 2.1% to 2.5%.

Nitrogen is essential as an austenite former and to impart strength. A minimum of 0.30% nitrogen is necessary for these functions. A maximum of 0.45% and preferably about 0.39% should be observed in order to avoid exceeding the solubility level of nitrogen in the steel and to avoid an unduly high work hardening rate. Preferably nitrogen ranges between about 0.32% and about 0.39%.

Copper is considered to be an essential element and is purposefully added within the range of 0.5% to about 1.0% for its effect as an austenite former and austenite stabilizer against transformation to martensite. Copper has a strong influence in lowering the work hardening rate and hence can be varied, preferably within the range of 0.5% to 0.9% in inverse proportion to the sum total of carbon plus nitrogen, in order to control the work hardening rate and facilitate attainment of the desired strength levels. A maximum of 1.0% copper, must be observed to avoid hot shortness, and a maximum of 0.9% is preferred for this reason. More preferably copper ranges between about 0.7% and about 0.9%.

Phosphorus, sulfur and silicon are not essential but are commonly present as impurities. For best mechanical properties, phosphorus is controlled to a maximum of about 0.03%, sulfur to a maximum of about 0.02% and silicon within the range of about 0.2% to about 0.5% due to its strong ferrite forming tendency.

Molybdenum, also commonly present as an impurity, should be controlled to a maximum of about 0.75% and preferably 0.5% maximum, since it is a ferrite former. Columbium, titanium and aluminum should be restricted to residual amounts since these are also ferrite formers.

Any one or more of the preferred or more preferred ranges indicated above can be used with any one or more of the broad ranges for the remaining elements set forth above.

Preferably drill collars in accordance with the invention will exhibit the following properties determined at the longitudinal outside diameter (OD) location:

magnetic permeability 1.004 max;
0.2% yield strength 85 ksi minimum;
ultimate tensile strength 120 ksi minimum;
percent elongation in 2 inches 35% minimum;
percent reduction of area 50% minimum;
stress corrosion cracking preferably immune (>1000 hours under stress of 75 ksi in boiling 5% NaCl+0.5% acetic acid).

A series of heats has been prepared, processed and tested, and these compositions are set forth in Table I. Mechanical properties for drill collars fabricated from these heats by hot forging at outside diameter (OD) and ¼ T (longitudinal) positions are set forth in Table II. These properties are for 7¾ inch through 11 inch outside diameter drill collars fabricated by hot forging, without warm working. It will be evident that steels of the invention meet the desired yield strength, tensile strength, reduction of area and elongation requirements, and that the strength levels are generally dependent on the sum total of carbon plus nitrogen, which prefereably ranges between about 0.46% and 0.55%. Heat 4, containing nitrogen in excess of the preferred range and a carbon plus nitrogen total of 0.57%, achieved a high strength level with a moderate decrease in ductility, thus indicating higher work hardening rate.

Stress corrosion cracking tests have been conducted and are summarized in Table III. It will be noted that the steel of the invention exhibits substantially greater resistance to stress corrosion cracking than the steel of U.S. Pat. No. 3,082,083.

The tests in boiling NaCl+acetic acid solution are considered to approximate more closely the actual working conditions for drill collars than the boiling $MgCl_2$ tests, the latter being a standard accelerated comparative corrosion test.

Tests in NACE solution (hydrogen sulfide) have also established the superiority of the steel of the invention over that of U.S. Pat. No. 3,082,083.

Mechanical tests have been conducted on drill collar test specimens from various positions, namely logitudinal outside diameter, longitudinal center, longitudinal ¼ T, transverse ¼ T and transverse center. It was found that higher yield and tensile strengths were exhibited at the outside diameter longitudinal position than at all other positions. However, it is believed that the OD longitudinal position is representative and should provide a satisfactory basis to determine adequacy of performance of the drill collars in actual use since the somewhat lower strengths at other positions vary directly in proportion to OD longitudinal strength.

A further series of heats was melted for the purposes of investigating magnetic permeability, the effect of hot work finishing temperature, the effect of variations in the sum total of carbon plus nitrogen and in the carbon:nitrogen ratio. The compositions of these heats are set forth in Table IV, with mechanical properties being summarized in Table V and magnetic permeabilities in Table VI.

In preparation of test samples the steels were hot rolled at two different finishing temperatures as shown in Tables V and VI. The cold working reported in Table VI involved bending a specimen about ¼ inch in the center of its 4 inch section, then bending it flat. This was intended to simulate both a cold strengthening operation and possible deformation and straightening during service.

It is evident from Table V that a relatively low finishing temperature (preferably within the range of 677° to 760° C.) resulted in a surprising increase in yield strength and ultimate tensile strength, and a moderate decrease in percent elongation.

Heats 10, 11 and 12 were melted with manganese and nitrogen levels below the ranges of the steel of the invention for purposes of comparision. On the modified Schaeffler diagram these fell within the austenite+martensite area. It is apparent from Table VI that the magnetic permeabilities of these specimens were acceptable in the as-hot-rolled condition but that some transformation to martensite occurred when cold worked. Heat 11 exhibited anomalous behavior, which cannot presently be explained, in undergoing only slight transformation.

It is evident from Table VI that the steels of the invention are capable of developing higher than 100 ksi yield strengths in the cold worked condition while still maintaining magnetic permeability at <1.004.

Progressively higher carbon plus nitrogen levels resulted in progressive and substantial increases in yield and ultimate tensile strengths. At the highest level of 0.55 carbon plus nitrogen (Heat 15) the elongation and reduction of area values were moderately lower for the specimen hot finished at 732° C.

Heat 16, having a carbon:nitrogen ratio of 1:1, exhibited unacceptably low reduction of area values and hence demonstrates the criticality of a carbon:nitrogen ratio not greater than about 0.6:1.

Hot forging of the steel of the invention into drill collars can readily be carried out with a finishing temperature within the range of about 675° to 760° C. Hence the data in Tables V and VI, although derived from flat rolled specimens, are also illustrative of properties which would be obtained by hot forging.

While the invention has been described primarily with reference to the fabrication of non-magnetic drill collars, it will be understood that the utility of the steel is not so limited and that it is suited to other applications where a combination of strength, resistance against stress corrosion cracking and freedom from magnetic effects are required. Accordingly, no limitations are to be inferred except as set forth in the appended claims.

TABLE I

| Heat | C | Mn | Cr | Ni | N | C + N |
|---|---|---|---|---|---|---|
| 1* | 0.16 | 12.2 | 18.0 | 2.2 | 0.36 | 0.52 |
| 2* | 0.13 | 12.7 | 17.9 | 2.1 | 0.33 | 0.46 |
| 3 | 0.11 | 12.4 | 16.8 | 2.1 | 0.33 | 0.44 |
| 4* | 0.16 | 12.5 | 18.1 | 2.6 | 0.41 | 0.57 |
| 5* | 0.15 | 12.8 | 17.2 | 2.1 | 0.33 | 0.48 |
| 6* | 0.14 | 12.95 | 16.50 | 2.29 | 0.31 | 0.45 |
| 7* | 0.15 | 12.63 | 17.39 | 2.38 | 0.35 | 0.50 |
| 8* | 0.13 | 12.51 | 18.29 | 1.53 | 0.33 | 0.46 |
| 9* | 0.14 | 13.05 | 18.35 | 2.65 | 0.39 | 0.53 |

All Heats:
Cu 0.5–1.0%;
P < 0.03;
S < 0.02;
Si < 0.5
*Steels of the invention

TABLE II

| Heat | Test Position | Hot Forged (No Warm Working) 0.2% Y.S. (ksi) | U.T.S. (ksi) | % Elong. in 2" | % R.A. |
|---|---|---|---|---|---|
| 1* | OD | 102.4 | 135.3 | 41.4 | 63.2 |
| | ¼ T | 91.9 | 130.3 | 41.4 | 55.2 |
| 2* | OD | 92.9 | 128.8 | 46.5 | 61.3 |
| | ¼ T | 84.9 | 123.8 | 46.00 | 61.9 |
| 3 | OD | 95.6 | 128.8 | 45.7 | 64.0 |
| | ¼ T | 79.5 | 121.8 | 47.7 | 60.3 |
| 4* | OD | 107.3 | 142.4 | 34.8 | 56.6 |
| | ¼ T | 105.3 | 141.4 | 37.3 | 58.9 |
| 5* | OD | 98.5 | 130.8 | 41.0 | 60.5 |
| | ¼ T | 90.4 | 129.8 | 44.1 | 60.6 |
| 6* | OD | 90.5 | 124.8 | 46.1 | 64.1 |
| | ¼ T | 82.9 | 121.3 | 48.5 | 66.6 |
| 7* | OD | 100.6 | 136.7 | 36.7 | 52.8 |
| | ¼ T | 78.4 | 125.8 | 48.2 | 63.5 |
| 8* | OD | 97.9 | 130.3 | 42.8 | 59.3 |
| | ¼ T | 84.2 | 121.8 | 40.4 | 40.4 |
| 9* | OD | 99.1 | 139.2 | 38.7 | 57.6 |
| | ¼ T | 77.2 | 124.3 | 46.1 | 46.7 |

| Heat ¼ T Long. | Charpy ft - lbs (average of 2) |
|---|---|
| 2 | 64.2 |
| 3 | 137.2 |
| 5 | 58.0 |
| 6 | 122.5 |
| 7 | 101.5 |
| 8 | 26.0 |
| 9 | 42.0 |

*Steels of the invention

TABLE III

| Material & Condition | Stress Corrosion Resistance: Hours to failure, under stress of 75 ksi | 50 ksi | 25 ksi | 10 ksi |
|---|---|---|---|---|
| Boiling 42% $MgCl_2$ | | | | |
| USP 3082083 warm worked @ 1100° F. | 0.8 | 1.1 | 3.0 | 7.0 |
| Steel of Invention | 0.4 | 1.1 | >1000 | >1000 |
| Boiling 5% NaCl + 0.5% Acetic acid | | | | |
| USP 3082083 warm worked @ 1100° F. | — | — | 26 | — |
| Steel of Invention | >1000 | >1000 | >1000 | — |

TABLE IV

| Heat | C | Compositions - Weight Percent: Mn | Si | Cr | Ni | N | Cu | C + N |
|---|---|---|---|---|---|---|---|---|
| 10 | 0.12 | 9.42 | 0.33 | 15.63 | 2.39 | 0.20 | 0.51 | 0.32 |
| 11 | 0.096 | 9.56 | 0.35 | 15.60 | 2.37 | 0.23 | 0.50 | 0.326 |
| 12 | 0.12 | 9.56 | 0.29 | 16.31 | 2.38 | 0.20 | 0.50 | 0.32 |

TABLE IV-continued

| Heat | C | Compositions - Weight Percent: Mn | Si | Cr | Ni | N | Cu | C + N |
|---|---|---|---|---|---|---|---|---|
| 13* | 0.12 | 11.71 | 0.29 | 17.54 | 2.24 | 0.32 | 0.50 | 0.44 |
| 14* | 0.16 | 11.90 | 0.29 | 17.57 | 2.27 | 0.36 | 0.50 | 0.52 |
| 15* | 0.15 | 11.96 | 0.30 | 17.52 | 2.28 | 0.40 | 0.50 | 0.55 |
| 16 | 0.24 | 11.71 | 0.24 | 17.50 | 2.29 | 0.24 | 0.50 | 0.48 |

P&S < 0.04% each, Mo 0.16%–0.27%
*Steels of the invention.

TABLE V

| Heat | Finish Temp. °C. | Mechanical Properties: 0.2% Y.S. ksi | U.T.S. ksi | % Elong. in 50.8 mm | % Red. of Area |
|---|---|---|---|---|---|
| 10 | 732 | 100.4 | 124.3 | 42.5 | 62.2 |
| 10 | 882 | 93.2 | 126.4 | 45.0 | 63.0 |
| 11 | 732 | 106.8 | 126.8 | 40.0 | 64.3 |
| 12 | 732 | 103.0 | 124.0 | 40.0 | 61.0 |
| 12 | 882 | 85.0 | 121.0 | 45.0 | 67.6 |
| 13* | 732 | 114.0 | 142.0 | 36.0 | 63.9 |
| 13* | 882 | 108.5 | 133.2 | 40.0 | 62.7 |
| 14* | 732 | 123.5 | 139.2 | 34.5 | 50.0 |
| 14* | 882 | 107.4 | 133.0 | 37.7 | 57.4 |
| 15* | 732 | 134.4 | 149.0 | 30.5 | 49.6 |
| 15* | 882 | 117.9 | 142.2 | 37.2 | 59.3 |
| 16 | 732 | 120.0 | 136.2 | 30.8 | 32.5 |
| 16 | 882 | 105.1 | 133.0 | 36.8 | 45.4 |

*Steels of the invention

TABLE VI

| Heat | Finish Temp. °C. | Magnetic Permeability: As-Hot-Rolled 500 Oe | Cold Worked 500 Oe |
|---|---|---|---|
| 10 | 732 | 1.0024 | 1.0071 |
| 10 | 882 | 1.0026 | 1.0063 |
| 11 | 732 | 1.0022 | 1.0063 |
| 12 | 732 | 1.0022 | 1.0057 |
| 12 | 882 | 1.0022 | 1.0060 |
| 13* | 732 | 1.0021 | 1.0025 |
| 13* | 882 | 1.0020 | 1.0022 |
| 14* | 732 | 1.0020 | 1.0020 |
| 14* | 882 | 1.0020 | 1.0020 |
| 15* | 732 | 1.0019 | 1.0020 |
| 15* | 882 | 1.0020 | 1.0018 |
| 16 | 732 | 1.0020 | 1.0021 |
| 16 | 882 | 1.0019 | 1.0020 |

*Steels of the invention

We claim:

1. An austenitic stainless steel having a 0.2% yield strength of at least 85 ksi, a stress corrosion resistance of greater than 1,000 hours under stress of 25 ksi in boiling 42% magnesium chloride solution, and a reduction of area of at least about 50% in the hot worked condition, and a magnetic permeability not greater than 1.004 at 500 oersteds in the cold worked condition, said steel consisting essentially of, in weight percent, from 0.12% to about 0.20% carbon, 11% to about 14% manganese, about 0.80% maximum silicon, about 0.04% maximum phosphorus, about 0.025% maximum sulfur, about 16% to about 19% chromium, about 1.5% to 2.7% nickel, 0.30% to 0.45% nitrogen, about 0.7% to about 0.9% copper, about 0.75% maximum molybdenum, and balance essentially iron, with the carbon:nitrogen ratio being not greater than about 0.6:1.

2. The steel claimed in claim 1, consisting essentially of from 0.12% to 0.18% carbon, 11% to about 13% manganese, about 0.5% maximum silicon, about 0.03% maximum phosphorus, about 0.02% maximum sulfur, about 17% to about 18.5% chromium, about 1.8% to 2.5% nickel, about 0.32% to about 0.39% nitrogen, about 0.7% to about 0.9% copper, about 0.5% maximum molybdenum, and balance essentially iron.

3. The steel claimed in claim 1, wherein the nickel equivalent and chromium equivalent fall wholly within the austenite area of the Schaeffler diagram of the accompanying drawing, when the nickel equivalent is calculated as % Ni+30×% C+0.87 for manganese+0.33×% Cu+20 (% N−0.045), and the chromium equivalent is calculated as % Cr+% Mo+1.5×% Si.

4. The steel claimed in claim 1, wherein the sum total of carbon plus nitrogen ranges between about 0.46% and 0.55%.

5. The steel claimed in claim 1, wherein carbon ranges from about 0.12% to about 0.18%.

6. The steel claimed in claim 1, wherein nickel ranges from about 2.1% to 2.5%.

7. The steel claimed in claim 1, wherein nitrogen ranges from about 0.32% to about 0.39%.

8. A non-magnetic oil well drill collar produced by hot forging having a 0.2% yield strength greater than 85 ksi at the longitudinal outside diameter position, a stress corrosion cracking resistance greater than 1000 hours under stress of 75 ksi in boiling 5% NaCl+0.5% acetic acid solution, and a magnetic permeability not greater than 1.004 at 500 oersteds, said collar being hot forged from an austenitic stainless steel consisting essentially of, in weight percent, from 0.12% to about 0.20% carbon, 11% to about 14% manganese, about 0.80% maximum silicon, about 0.04% maximum phosphorus, about 0.025% maximum sulfur, about 16% to about 19% chromium, about 1.5% to 2.7% nickel, 0.30% to 0.45% nitrogen, 0.5% to about 1.0% copper, about 0.75% maximum molybdenum, and balance essentially iron, with the carbon:nitrogen ratio being not greater than about 0.6:1.

9. The drill collar claimed in claim 8, consisting essentially of from 0.12% to 0.18% carbon, 11% to about 13% manganese, about 0.5% maximum silicon, about 0.03% maximum phosphorus, about 0.02% maximum sulfur, about 17% to about 18.5% chromium, about 1.8% to 2.5% nickel, 0.32% to about 0.39% nitrogen, 0.5% to about 0.9% copper, about 0.5% maximum molybdenum, and balance essentially iron.

10. The drill collar claimed in claim 8, wherein the nickel equivalent and chromium equivalent fall wholly within the austenite area of the Schaeffler diagram of the accompanying drawing, when the nickel equivalent is calculated as % Ni+30×% C+0.87 for manganese+0.33×% Cu+20 (% N−0.045), and the chromium equivalent is calculated as % CR+% Mo+1.5×% Si.

11. The drill collar claimed in claim 8, wherein the sum total of carbon plus nitrogen ranges between about 0.46% and 0.55%.

12. The drill collar claimed in claim 8, wherein carbon ranges from about 0.12% to about 0.18%.

13. The drill collar claimed in claim 8, wherein nickel ranges from abut 2.1% to 2.5%.

14. The drill collar claimed in claim 8, wherein nitrogen ranges from about 0.32% to about 0.39%.

15. The drill collar claimed in claim 8, wherein copper ranges from about 0.7% to about 0.9%.

16. A method of fabricating a non-magnetic oil well drill collar, having a 0.2% yield strength greater than 85 ksi at the longitudinal outside diameter position, a stress corrosion cracking resistance greater than 1000 hours under stress of 75 ksi in boiling 5% NaCl+0.5% acetic acid solution, and a magnetic permeability not greater than 1.004 at 500 oersteds, comprising the steps of providing a steel billet consisting essentially of, in weight percent, from 0.12% to about 0.20% carbon, 11% to about 14% manganese, about 0.80% maximum silicon, about 0.04% maximum phosphorus, about 0.025% maximum sulfur, about 16% to about 19% chromium, about 1.5% to 2.7% nickel, 0.30% to 0.45% nitrogen, 0.5% to about 1.0% copper, about 0.75% maximum molybdenum, and balance essentially iron, with the carbon:nitrogen ratio being not greater than about 0.6:1, heating said billet within the range of about 982° to about 1149° C. and hot forging the billet to final diameter without intermediate reheating at a finishing temperature of at least about 677° C.

17. The method claimed in claim 16, wherein said steel billet consists essentially of from 0.12% to 0.18% carbon, 11% to about 13% manganese, about 0.5% maximum silicon, about 0.03% maximum phosphorus, about 0.02% maximum sulfur, about 17% to about 18.5% chromium, about 1.8% to 2.5% nickel, 0.32% to about 0.39% nitrogen, 0.5% to about 0.9% copper, about 0.5% maximum molybdenum, and balance essentially iron.

18. The method claimed in claim 16, wherein the nickel equivalent and chromium equivalent of said steel billet fall wholly within the austenite area of the Schaeffler diagram of the accompanying drawing, when the nickel equivalent is calculated as % Ni+30×% C+0.87 for manganese+0.33 ×% Cu+20 (% N−0.045), and the chromium equivalent is calculated as % Cr+% Mo+1.5 ×% Si.

19. The method claimed in claim 16, wherein the sum total of carbon plus nitrogen ranges between about 0.46% and 0.55%.

20. The method claimed in claim 16, wherein carbon ranges from about 0.12% to about 0.18%.

21. The method claimed in claim 16, wherein nickel ranges from about 2.1% to 2.5%.

22. The method claimed in claim 16, wherein nitrogen ranges from about 0.32% to about 0.39%.

23. The method claimed in claim 16, wherein copper ranges from about 0.7% to about 0.9%.

* * * * *.